US010293356B2

(12) United States Patent
Lee

(10) Patent No.: US 10,293,356 B2
(45) Date of Patent: May 21, 2019

(54) COMPACT CONTAINER HAVING HIDING/REVEALING PUMP OUTLET

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 0 days.

(21) Appl. No.: 15/572,104

(22) PCT Filed: May 10, 2016

(86) PCT No.: PCT/KR2016/004850

§ 371 (c)(1),
(2) Date: Nov. 6, 2017

(87) PCT Pub. No.: WO2016/186357

PCT Pub. Date: Nov. 24, 2016

(65) Prior Publication Data

US 2018/0290161 A1 Oct. 11, 2018

(30) Foreign Application Priority Data

May 20, 2015 (KR) ..... 20-2015-0003227

(51) Int. Cl.
*B05B 11/00* (2006.01)
*A45D 34/00* (2006.01)
(Continued)

(52) U.S. Cl.
CPC ..... *B05B 11/00416* (2018.08); *A45D 34/00* (2013.01); *A45D 40/00* (2013.01);
(Continued)

(58) Field of Classification Search
CPC ..... B05B 11/00416; B05B 11/0037; B05B 11/0032; B05B 11/3059; B05B 11/0038;
(Continued)

(56) References Cited

U.S. PATENT DOCUMENTS 5,085,347 A * 2/1992 Hayes ..... B05B 11/0032 222/153.02
5,090,601 A * 2/1992 Thanisch ..... B65D 47/2012 222/507
(Continued)

FOREIGN PATENT DOCUMENTS

KR 20-0310095 Y1 4/2003
KR 20-0347811 Y1 4/2004
(Continued)

*Primary Examiner* — David P Angwin
*Assistant Examiner* — Bob Zadeh
(74) *Attorney, Agent, or Firm* — Heedong Chae; Lucem, PC

(57) ABSTRACT

A cosmetic container having a hiding/revealing pump outlet wherein an inner container is embedded in a cylindrical outer container includes: a first coupling body, which has a pump installation hole formed to deviate towards one side, is fixed/coupled to the upper portion of the inner container; a second coupling body, which has a pump penetration hole formed to deviate towards one side, is fixed/coupled to the upper portion of the first coupling body; a pump installed so as to penetrate the pump penetration hole of the second coupling body and the pump installation hole of the first coupling body; a pressing member configured to be exposed to the upper portion of the pump penetration hole of the second coupling body; and a cap rotatably coupled to the upper portion of the second coupling body.

4 Claims, 11 Drawing Sheets

(51) Int. Cl.
*A45D 40/00* (2006.01)
*B65D 47/00* (2006.01)

(52) U.S. Cl.
CPC ..... *B05B 11/0032* (2013.01); *B05B 11/0037* (2013.01); *B05B 11/3059* (2013.01); *B65D 47/00* (2013.01); *A45D 2040/0018* (2013.01); *A45D 2200/054* (2013.01); *A45D 2200/055* (2013.01); *B05B 11/0038* (2018.08)

(58) Field of Classification Search
CPC .. A45D 34/00; A45D 40/00; A45D 2200/054; A45D 2200/055; A45D 2040/0018; B65D 47/00; B65D 47/2012; B65D 47/212; B65D 47/266
See application file for complete search history.

(56) References Cited

U.S. PATENT DOCUMENTS 5,203,841 A * 4/1993 Kitabayashi ..... B65D 47/2043 222/402.11
5,579,948 A * 12/1996 Lin ..... A47G 19/2266 215/229
7,857,174 B2 * 12/2010 Michaux ..... B05B 11/3049 222/507
8,714,412 B2 * 5/2014 Benigni ..... A45D 34/02 222/153.13
2009/0071985 A1 * 3/2009 Ki ..... B05B 11/0027 222/309
2010/0098480 A1 * 4/2010 Byeon ..... B05B 11/3053 401/136
2016/0324294 A1 * 11/2016 Kim ..... A45D 34/04
2018/0290161 A1 * 10/2018 Lee ..... B05B 11/0032

FOREIGN PATENT DOCUMENTS

KR 20-0425584 Y1 9/2006
KR 200425584 Y1 * 9/2006
KR 10-2012-0061260 A 6/2012
KR 20120061260 A * 6/2012 ..... B05B 11/3059
KR 10-1267966 B1 5/2013

* cited by examiner

COMPACT CONTAINER HAVING HIDING/REVEALING PUMP OUTLET

CROSS-REFERENCE TO RELATED APPLICATION

This application claims the benefit of Korean application No. 20-2015-0003227, filed on May 20, 2015 with the Korean Intellectual Property Office, the disclosure of which is incorporated herein by reference.

TECHNICAL FIELD

The present invention relates to a cosmetic container having an hiding/revealing pump outlet, and more particularly, to a cosmetic container having an hiding/revealing outlet, wherein an inner container is embedded in a cylindrical outer container; a first coupling body, which has a pump installation hole formed to deviate towards one side, is fixed/coupled to the upper portion of the inner container; a second coupling body, which has a pump penetration hole formed to deviate towards one side, is fixed/coupled to the upper portion of the first coupling body; a pump is installed so as to penetrate the pump penetration hole of the second coupling body and the pump installation hole of the first coupling body; a pressing member is configured to be exposed to the upper portion of the pump penetration hole of the second coupling body; a cap is rotatably coupled to the upper portion of the second coupling body such that, if the outer container is rotated 180 degrees clockwise, by holding the cap, the pressing member is rotated and causes an outlet of the pressing member to protrude out of an outlet hiding/repealing hole and, if rotated 180 degrees counterclockwise, the outlet of the pressing member is retracted into the outlet hiding/revealing hole; and accordingly, when the cosmetic product is to foe used, the outlet is made to protrude out of the cap and then used, and, when not used, the outlet is made to retract into the cap, thereby preventing contamination of the outlet.

In addition, the present invention relates to a cosmetic container having a hiding/revealing pump outlet, in which an opening/closing member is coupled to an upper portion, of the second coupling body, a cap formed therein with an outlet hiding/revealing hole is rotatably coupled to an upper portion of the opening/closing member, when the outer container fixed to the second coupling body is rotated at 180 degrees in the counterclockwise direction by holding the cap, a sliding door formed on the opening/closing member is rotated to block the outlet hiding/revealing hole, and when rotated at 180 degrees in the clockwise direction, the sliding door is rotated to open the outlet hiding/revealing hole, thereby preventing contamination of the outlet.

BACKGROUND ART

Cosmetics refer to as goods used for a human body to enable; a human body to be clean and beautiful so as to add charm and change appearance brightly or to maintain or improve a health of a skin or a hair.

Based on the purpose of use, the cosmetics are classified into facial cleansing; cosmetics used for removing sebum, wastes and contaminants on a surface of a skin, base cosmetics used for properly supplying moisture and oil to the skin, color cosmetics used for expressing beautiful colors, hair cosmetics used for protecting hairs and supplying nutrition as well as removing foreign substances from hairs or scalp, and perfumes obtained by dissolving fragrant materials in alcohol or the like and used for giving a fragrance to others.

As the above cosmetics have been developed, development of various cosmetics containers for containing cosmetic materials also has been required.

In general, the cosmetic material is taken out and applied to the skin by conventionally using a container having a simple opening/closing function to store and use the cosmetic materials formed in a liquid or gel state such as lotion, cream, gel, shampoo, and rinse.

However, because the conventional cosmetic container has a difficulty to control the amount of discharged cosmetic material, the cosmetic materials are wasted.

In order to solve the above problem, as shown in FIG. 1, a dip tube cosmetic container having a pump has been disclosed in Korean utility Model Registration No. 20-D372891, such that a fixed amount can be discharged by the pump upon using a cosmetic material, and the cosmetic material can be prevented from being contaminated by preventing the cosmetic material from being exposed, to the outside.

However, because an outlet in the above related art is always open, air or various foreign substances are introduced through an entrance of the outlet, accordingly, cosmetics remaining in the outlet are oxidized and deteriorated or the cosmetics on the entrance side are hardened.

To solve the problems as the above, a cap is coupled to a periphery of the outlet on a pump container, however, the cap is required to be opened and closed when the cosmetics are used and there is a risk to lose the cap. In addition, when the cap is installed on the outlet to block the outlet, the hinge portion is broken upon repeatedly opening/closing the cap because the cap is hinged around the outlet.

In order to solve the above problem, as shown in FIG. 2, Korean Patent No. 02-0421164 has been disclosed. The above disclosure relates to an outlet pump capable of blocking; an outlet, in which an outlet of a discharging pump is blocked by a stopper member when a cosmetic is not discharged for use, such that the cosmetic present on the outlet can be prevented from being deteriorated and hardened due to contact with air.

However, according to the above related art, there is inconvenience in that the sliding door type stopper member for blocking the outlet is required to foe manually opened and closed laterally in a sliding manner to discharge the cosmetic in the pump container for use. When the cosmetic is not used, there is a problem that the cosmetic is discharged by unintentionally pressing a pressing member.

In order to solve the above problem, as shown in FIG. 3, Korean Patent Registration No. 20-0425584 has been disclosed. The above disclosure relates to a cap-rotation type device for opening/closing a stopper member of a cosmetic container, in which the stopper member is automatically opened and closed according to the rotation of the cap for protecting an outlet, so that an inconvenience in use can be removed, contamination around the outlet can be prevented, and the pump container can be prevented from discharging the cosmetic due to a malfunction.

However, according to the above related art, because the outlet discharges the cosmetic while being located in the cap without being exposed to the outside of the cap of the pump container, there is an inconvenience in that the pump container is required to be tilted so as to use the cosmetic, and because the cosmetic easily fails into the inside of the cap, there is a problem in that the inside of the cap is contaminated.

DISCLOSURE

Technical Problem

To solve the above problems, the present invention provides a cosmetic container having a hiding/revealing pump outlet in which an inner container is embedded in a cylindrical outer container; a first coupling body, which has a pump installation hole formed to deviate towards one side, is fixed/coupled to the upper portion of the inner container; a second coupling body, which has a pump penetration hole formed to deviate towards one side, is fixed/coupled to the upper portion of the first coupling body; a pump is installed so as to penetrate the pump penetration hole of the second coupling body and the pump installation hole of the first coupling body; a pressing member is configured to be exposed to the upper portion of the pump penetration hole of the second coupling body; a cap is rotatably coupled to the upper portion of the second coupling body such that, if the outer container is rotated 180 degrees clockwise by holding the cap, the pressing member is rotated and causes an outlet of the pressing member to protrude out of an outlet hiding/revealing hole and, if rotated 180 degrees counterclockwise, the outlet of the pressing member is retracted into the outlet hiding/revealing hole; and accordingly, when the cosmetic product is to be used, the outlet is made to protrude out of the cap and then used, and, when not used, the outlet is made to retract into the cap, thereby preventing contamination of the outlet.

In addition, the present invention provides a cosmetic container having an hiding/revealing pump outlet, in which an opening/closing member is coupled to an upper portion of the second coupling body, a cap formed therein with an outlet hiding/revealing hole is rotatably coupled to an upper portion, of the opening/closing member, when the cuter container fixed to the second coupling body is rotated at 180 degrees in the counterclockwise direction by holding the cap, a sliding door formed on the opening/closing member is rotated to block the outlet hiding/revealing hole, and when rotated at 180 degrees in the clockwise direction, the sliding door is rotated to open the outlet hiding/revealing hole, thereby preventing contamination of the outlet.

In addition, according to the present invention, there is provided with a cosmetic container having an hiding/revealing pump outlet, in which a latching groove is formed on an outer peripheral surface of the second coupling body, and a latching protrusion is formed at a lower end of the opening/closing member coupled to the upper portion of the second coupling body, thus the latching protrusion is released from the latching groove by passing over a latching sill when the outer container fixed to the second coupling body is rotated at 180 degrees in the clockwise direction by holding the cap, and the latching protrusion is fastened into the latching groove by passing over the latching sill when the outer container is rotated in the counterclockwise direction by holding the cap, thereby confirming a blocked state of the outlet hiding/revealing hole through the sense on a hand with a clicking sound.

In addition, according to the present, invention, there is provided with a cosmetic container having an hiding/revealing pump outlet, in which a first press prevention part is formed on the upper portion of the second coupling body and a second press prevention part is formed on a lower side of the outlet of the pressing member, such that the first press prevention part of the second coupling body abuts against the second press prevention part of the pressing member while the outlet hiding/revealing hole is blocked, thus the cosmetic can be prevented from being discharged by pressing the pressing member of the pump due to a malfunction.

Technical Solution

The present invention provides a cosmetic container having a hiding/revealing pump outlet, which includes an outer container (10) formed at an upper portion thereof with an entrance (11); an inner container (20) inserted into the outer container (10) for accommodating a cosmetic material in the inner container (20); a pushing plate (30) inserted into an inner lower side of the inner container (20) to push up the cosmetic material; a first coupling body (40) fixed to an upper portion of the inner container (20), and having a pump installation hole (41) eccentrically formed in the first coupling body (40); a second coupling body (50) fixed to an upper portion of the first coupling body (40), and having a pump penetration hole (51) eccentrically formed in the second coupling body (50); a pump (60) installed while passing through the pump installation hole (41) of the first coupling body (40) and the pump penetration hole (51) of the second coupling body (50) for pumping the cosmetic material; a pressing member (70) rotatably coupled to an upper portion of the pump (60), exposed on an upper portion of the second coupling body (50), and formed at one aide thereof with an outlet (71); and a cap (80) rotatably coupled to the upper portion of the second coupling body (50), and formed at one side thereof with an outlet hiding/revealing hole (81).

In addition, an opening/closing member (90) rotatably coupled to the upper portion of the second coupling body (50) is further included, in which a sliding door (91) for opening/closing the outlet hiding/revealing hole (31) of the cap (80) extends from an upper side surface of the opening/closing member (90).

In addition, a latching groove (52) is formed on an outer periphery of the second coupling body (50), a latching sill (53) is formed adjacent to the latching groove (52), and a latching protrusion (92) and a stopper (93) adjacent to the latching protrusion (92) are formed on a lower end of a side surface of the opening/closing member (90).

In addition, an elastic groove (96) is formed on an upper side of the latching protrusion (92) of the opening/closing member (90) to enable the latching protrusion (32) to elastically move up and down.

In addition, a first press prevention part (54) is formed on the second coupling body (50, and a second press prevention part (74) is formed on a lower side of the outlet (71) of the pressing member (70).

In addition, the cap (80) includes an outer wall (82) formed at one side thereof with the outlet hiding/revealing hole (81) and an inner wall (83) spaced apart from the outer wall (82) inward at a predetermined interval, a cap guide groove (831) and an outlet penetration groove (832) are formed on the inner wall (83), and a rotation protrusion wheel (833) rotatably coupled to the second coupling body (50) extends inward at a lower end of the inner wall (83).

In addition, the cap (80) is further formed at an upper inner side thereof with a cap cover (100) for pressing the pressing member (70) while moving up and down.

Advantageous Effects

According to the cosmetic container having the hiding/revealing pump outlet of the present invention, an inner container is embedded in a cylindrical outer container; a first coupling body, which has a pump installation hole formed to deviate towards one side, is fixed/coupled to the upper portion of the inner container; a second coupling body, which has a pump penetration bole formed to deviate towards one side, is fixed/coupled to the upper portion of the first coupling body; a pump is installed so as to penetrate the pump penetration hole of the second coupling body and the pump installation hole of the first coupling body; a pressing member is configured to be exposed to the tipper portion of the pump penetration hole of the second coupling body; a cap is rotatably coupled to the upper portion of the second coupling body such that, if the outer container is rotated 180 degrees clockwise by holding the cap, the pressing member is rotated and causes an outlet of the pressing member to protrude out of an outlet hiding/revealing hole and, if rotated 180 degrees counterclockwise, the outlet of the pressing member is retracted into the outlet hiding/revealing hole; and accordingly, when the cosmetic product is to be used, the outlet is made to protrude out of the cap and then used, and, when not used, the outlet is made to retract into the cap, thus contamination of the outlet can be prevented.

In addition, the present invention provides a cosmetic container having an hiding/revealing pump outlet, in which an opening/closing member is coupled to an upper portion of the second coupling body, a cap formed therein with an outlet hiding/revealing hole is rotatably coupled to an upper portion of the opening/closing member, when the outer container fixed to the second coupling body is rotated at 180 degrees in the counterclockwise direction by holding the cap, a sliding door formed on the opening/closing member is rotated to block the outlet hiding/revealing hole, and when rotated at 180 degrees in the clockwise direction the sliding door is rotated to open the outlet hiding/revealing hole, thus contamination of the outlet can be prevented.

In addition, a latching groove is formed on an outer peripheral surface of the second coupling body, and a latching protrusion is formed at a lower end of the opening/closing member coupled to the upper portion of the second coupling body, thus the latching protrusion is released from the latching groove by passing over a latching sill when the outer container fixed to the second coupling body is rotated at 180 degrees in the clockwise direction by holding the cap, and the latching protrusion is fastened into the latching groove by passing over the latching sill when the outer container is rotated in the counterclockwise direction by holding the cap, such that a blocked state of the outlet hiding/revealing hole can be confirmed through the sense on a hand with a clicking sound.

In addition, a first press prevention part is formed on the upper portion of the second coupling body and a second press prevention part is formed on a lower side of the outlet of the pressing member, thus the first press prevention part of the second coupling body abuts against the second press prevention part of the pressing member while the outlet hiding/revealing hole is blocked, such that the cosmetic can be prevented from being discharged by pressing the pressing, member of the pump due to a malfunction.

BEST MODE

Mode for Invention

An embodiment of a cosmetic container having a hiding/revealing pump outlet according to the present invention will be described with reference to the accompanying drawings.

Figure 1:
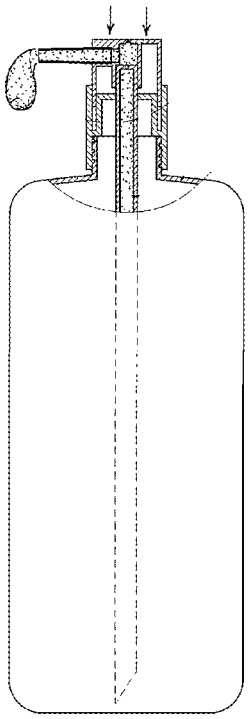
FIG. 1 shows a conventional dip tube cosmetic container with a pump.
Figure 2:
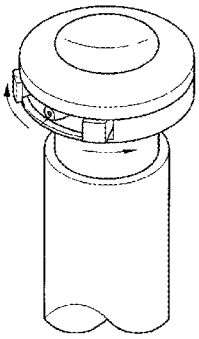
FIG. 2 shows a conventional discharging pump capable of blocking an outlet.
Figure 3:
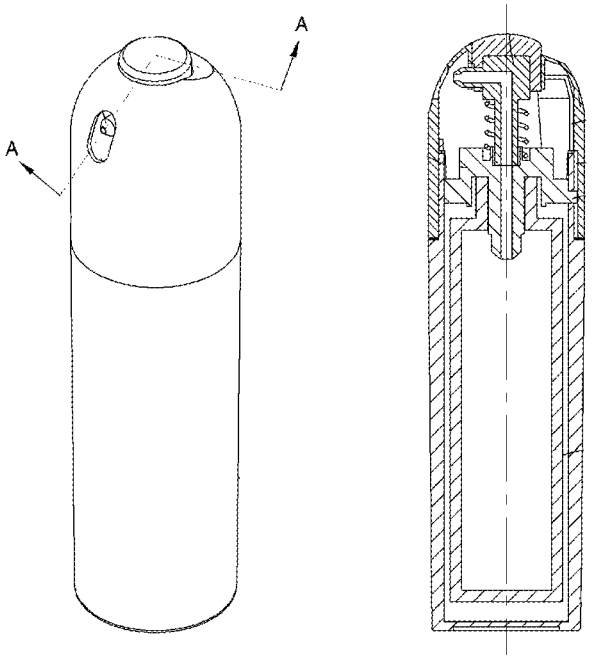
FIG. 3 shows a conventional cap-rotation type device, for opening/closing a stopper member of a cosmetic container.
Figure 4:
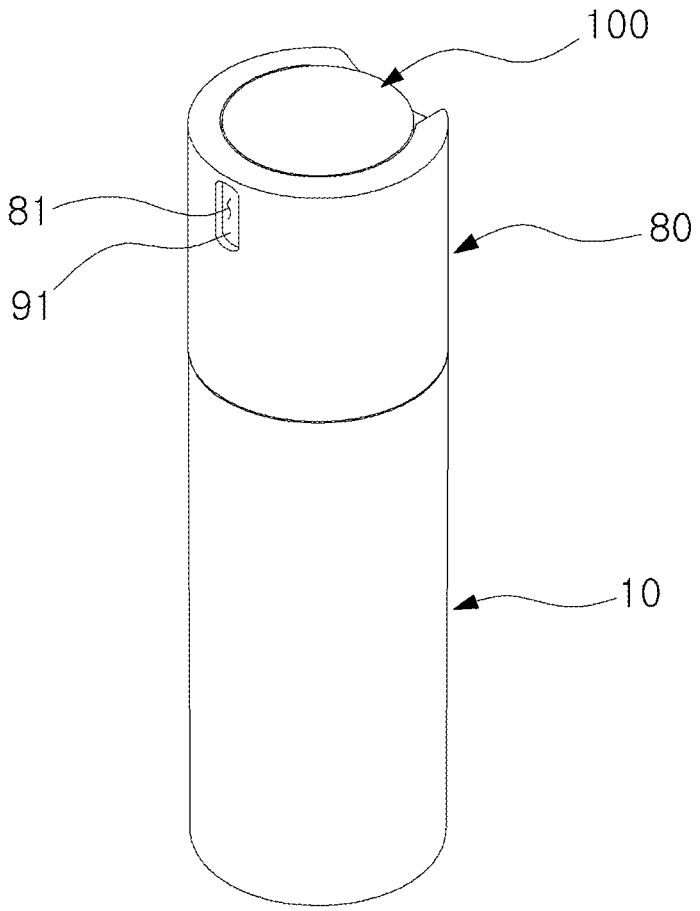
FIG. 4 is a perspective view showing a cosmetic container having a hiding/revealing pump outlet according to the present invention.
Figure 5:
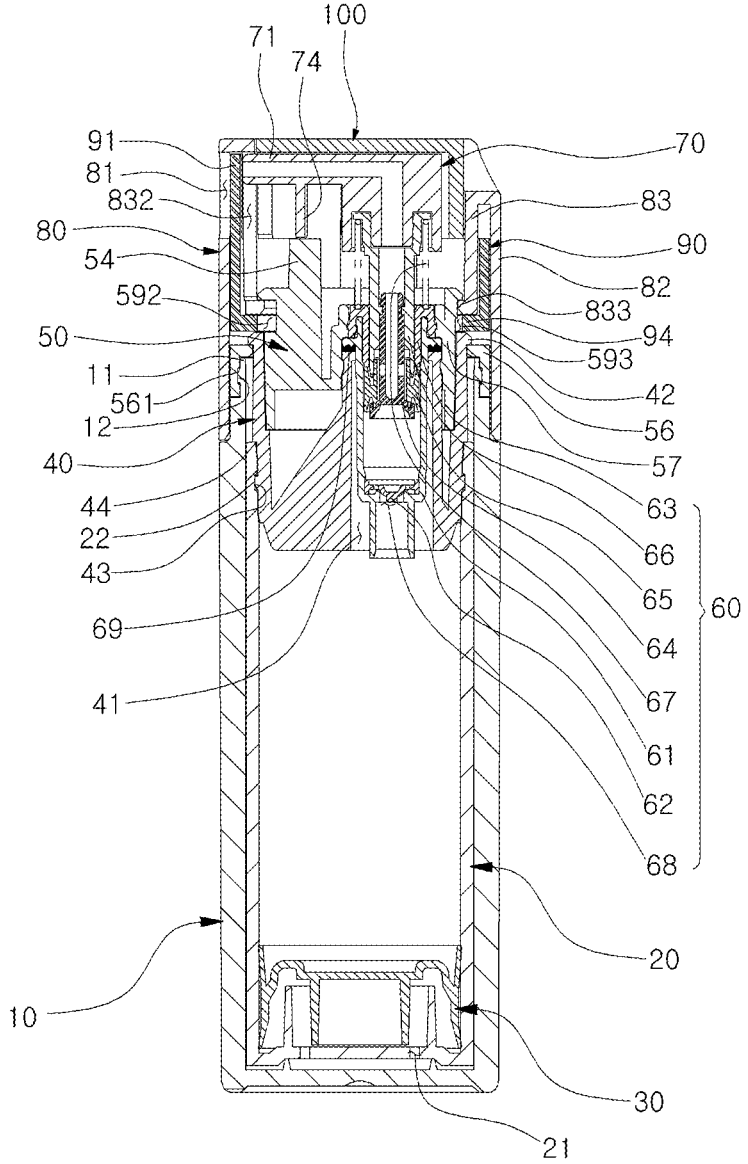
FIG. 5 is an exploded perspective view showing a cosmetic container having a hiding/revealing pump outlet according to the present, invention.
Figure 6:
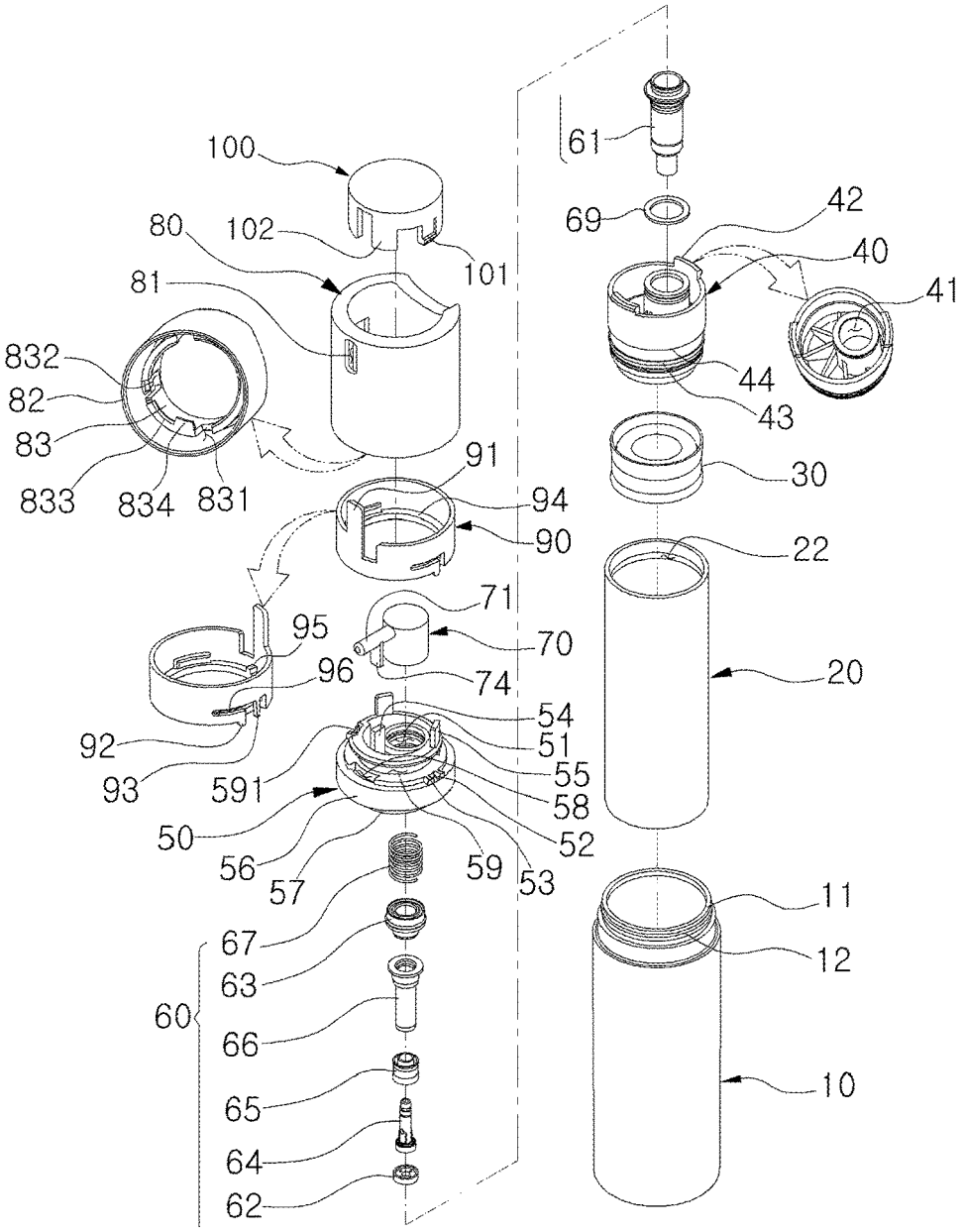
FIG. 6 is a sectional view showing a cosmetic container having a hiding/revealing pump cutlet according to the present invention.
Figure 7:
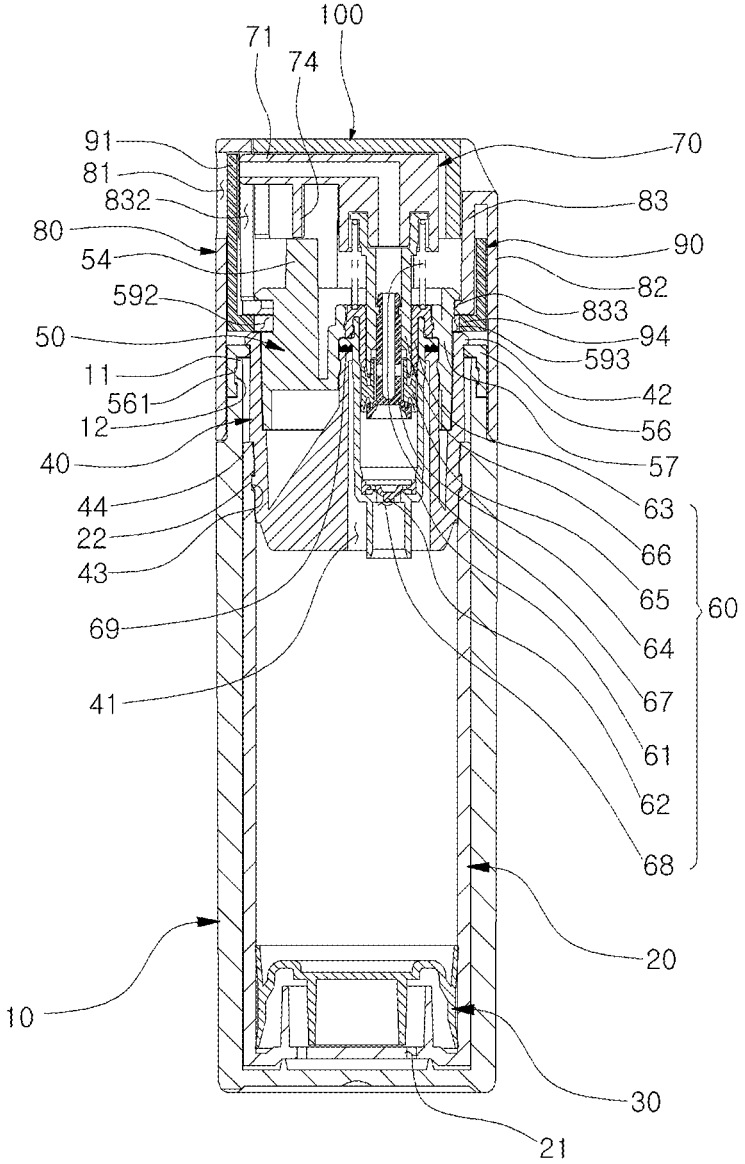
FIG. 7 is a sectional view showing a state in which an outlet of a cosmetic container having a hiding/revealing pump outlet according to the present invention protrudes to the outside.
Figure 8:
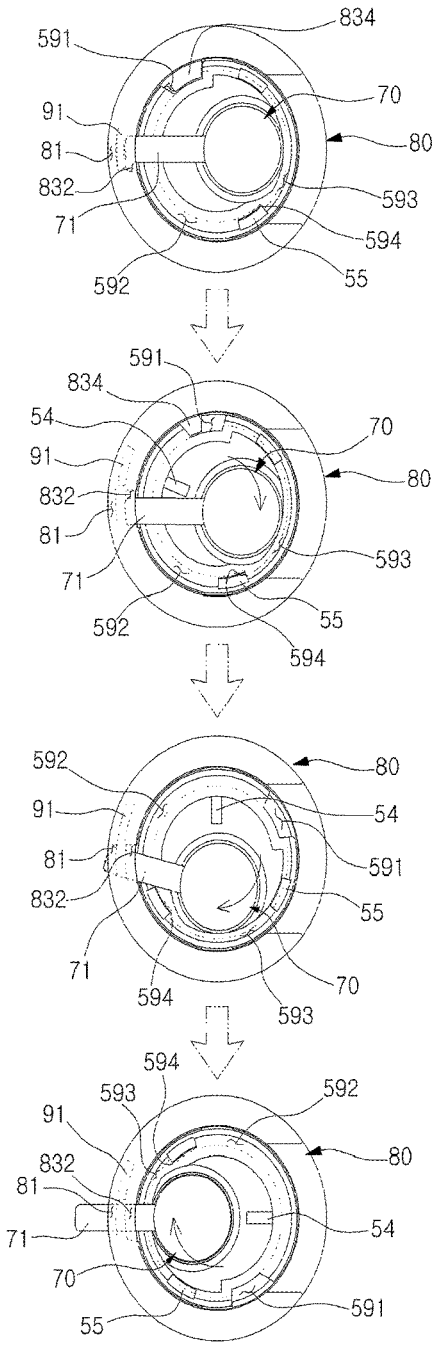
FIG. 8 is a plan view showing a state in which a pressing member of a cosmetic container having a biding/revealing pump outlet according to the present invention is rotated and causes an outlet of the pressing member to protrude out of an outlet hiding/revealing hole.
Figure 9:
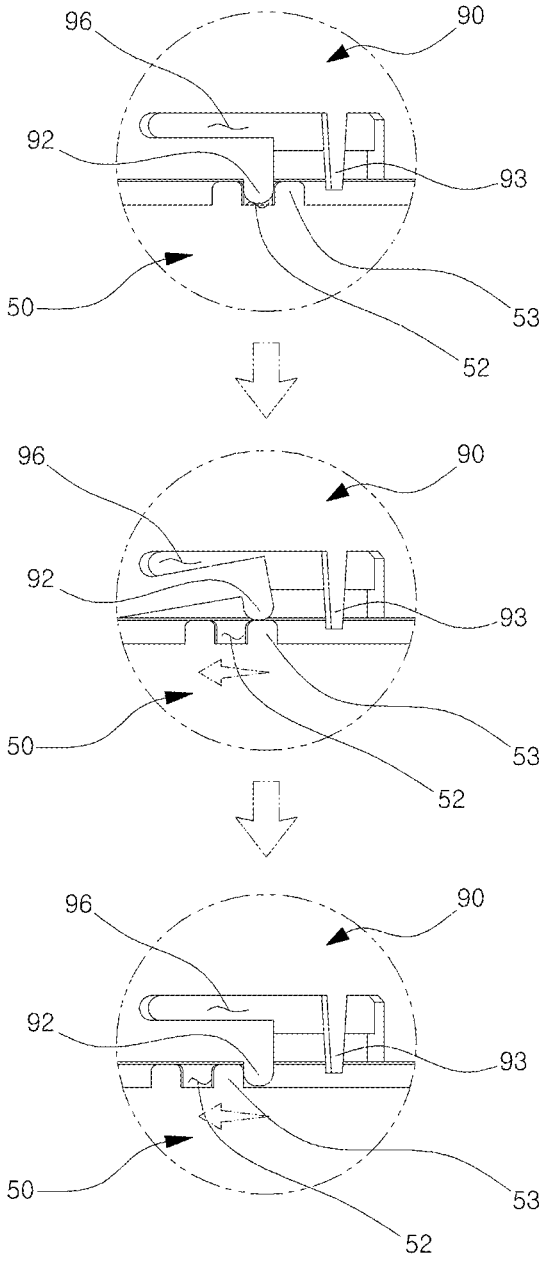
FIG. 9 is a partial sectional view showing a state in which an outer container of a cosmetic container having a hiding/revealing pump outlet according to the present invention is rotated and causes a latching protrusion of an opening/closing member to extend over a latching sill.
Figure 10:
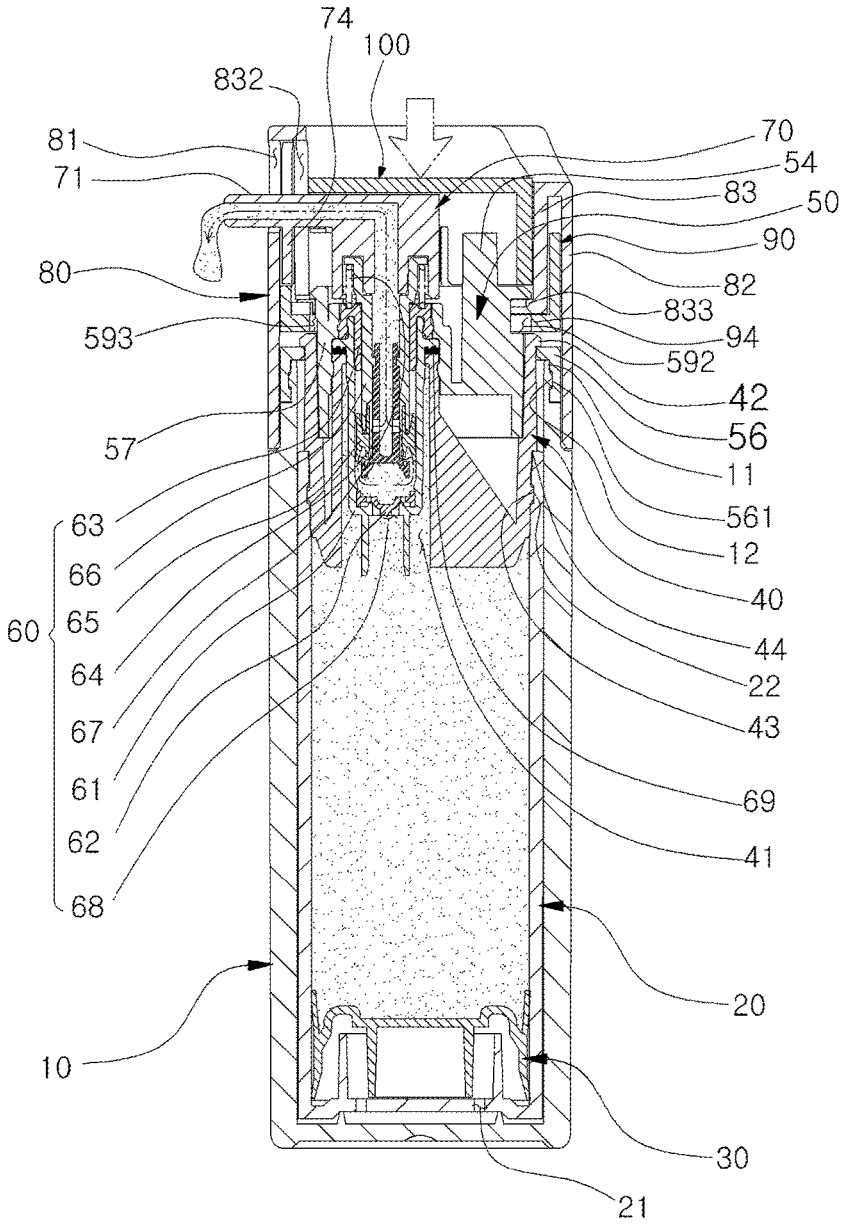
FIG. 10 is a sectional view showing a state in which a cosmetic material temporarily accommodated in the pump is discharged to the outside by pressing a cap cover of a cosmetic container having a hiding/revealing pump outlet according to the present invention.
Figure 11:
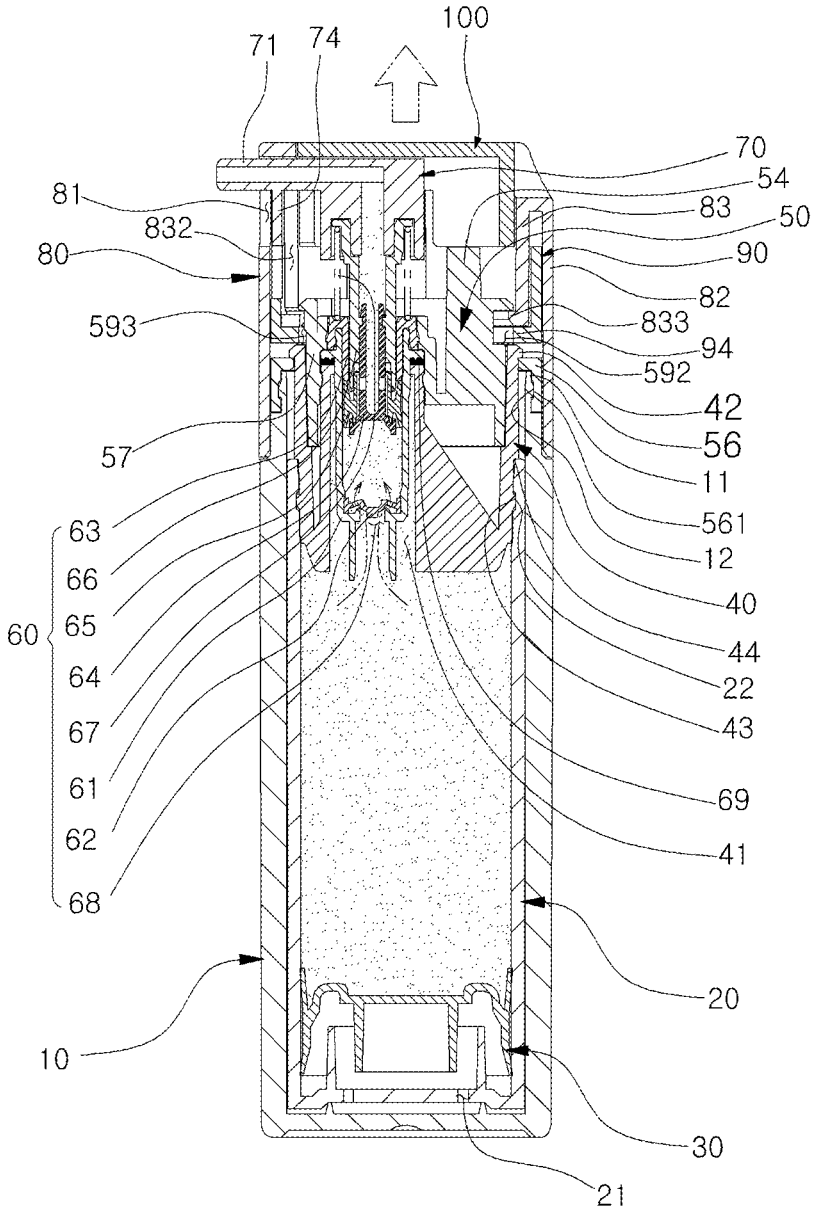
FIG. 11 is a sectional view showing a state in which a cosmetic material accommodated, in an inner container is moved into the pump by releasing pressure on a cap cover of a cosmetic container having a hiding/revealing pump outlet according to the present invention.

FIG. 4 is a perspective view showing a cosmetic container having a hiding/revealing pump outlet according to the present invention. FIG. 5 is an exploded perspective view showing a cosmetic container having a hiding/revealing pump outlet according to the present invention. FIG. 6 is a sectional view showing a cosmetic container having a hiding/revealing pump outlet according to the present invention. FIG. 7 is a cross-sectional view showing a state in which an outlet of a cosmetic container having a hiding/revealing pump outlet according to the present invention protrudes to the outside. FIG. 8 is a plan view showing a state in which a pressing member of a cosmetic container having a hiding/revealing pump outlet according to the present invention is rotated and causes an outlet of the pressing member to protrude out of an outlet hiding/revealing hole. FIG. 9 is a partial sectional view showing a state in which an outer container of a cosmetic container having a hiding/revealing pump outlet according to the present invention is rotated and causes a latching protrusion of an opening/closing member to extend over a latching sill. FIG. 10 is a sectional view showing a state in which a cosmetic material temporarily accommodated in the pump is discharged to the outside by pressing a cap cover of a cosmetic container having a hiding/revealing pump outlet according to the present invention. FIG. 11 is a sectional view showing a state in which a cosmetic material accommodated in an inner container is moved into the pump by releasing pressure on a cap cover of a cosmetic container having a hiding/revealing pump outlet according to the present invention.

According to the present invention, the cosmetic container having the hiding/revealing pump outlet includes an outer container 10 formed at an upper portion thereof with an entrance 11; an inner container 20 inserted into the outer container 10 for accommodating a cosmetic material in the inner container 20; a pushing plate 30 inserted into an inner lower side of the inner container 20 to push up the cosmetic material; a first coupling body 40 fixed to an upper portion of the inner container 20, and having a pump installation hole 41 eccentrically formed in the first coupling body 40; a second coupling body 50 fixed to an upper portion of the first coupling body 40, and having a pump penetration hole 51 eccentrically formed, in the second coupling body 50; a pump 60 installed through the pump installation hole 41 of the first coupling body 40 and the pump penetration hole 51 of the second coupling body 50 for pumping the cosmetic material; a pressing member 70 rotatably coupled to an upper portion of the pump 60 while being exposed on an upper portion of the second coupling body 50, and formed at one side thereof with an outlet 71; and a cap 80 rotatably coupled to the upper portion of the second coupling body 50, and formed at one side thereof with an outlet hiding/revealing hole 81.

The outer container 10 is formed in a cylindrical shape, and formed at an upper portion thereof with the entrance 11, in which a coupling protrusion wheel 12 is formed on an outer periphery of the entrance 11, thereby being coupled to the second coupling body 50.

The inner container 20 is inserted inside the outer container 10, and the cosmetic material is accommodated in the inner container 20.

A mounting groove 22 is formed on an upper inner periphery of the inner container 20, and an air inflow hole 21 into which external air flows is formed at a lower end of the inner container 20.

A pushing plate 30 which moves upward by a discharged amount of the cosmetic material discharged to the outside by pumping is inserted into an inner lower portion of the inner container 20.

The first coupling body 40 is fixed to the upper portion of the inner container 20, in which a lower portion of the first coupling body 40 is inserted into an upper side of the inner container 20.

A pump installation hole 41 installed therein with the pump 60 is eccentrically formed in the first coupling body 40.

A pair of fastening protrusions 42 protrude outward on an upper end of an outer periphery of the first coupling body 40 so as to be coupled to the second coupling body 50, and a mounting protrusion wheel 43 is formed on a lower outer periphery of the first coupling body 40 so as to be coupled to the mounting groove 22 of the inner container 20.

In addition, a step 44 is formed on the outer periphery of the first coupling body 40 and seated on an upper end of the inner container 20.

The second coupling body 50 is fixed to the upper portion of the first coupling body 40, while being coupled to an outer side of the entrance 11 of the outer container 10, and the pump penetration hole 51 which the pump 60 passes through is eccentrically formed.

An outer lower extension protrusion wheel 56 and an inner lower extension protrusion wheel 57 inwardly spaced apart from the outer lower extension protrusion wheel 56 by a predetermined interval are formed at the lower portion of the second coupling body 50, in which the outer lower extension protrusion wheel 56 is formed on an inner periphery thereof with a coupling groove 561 to be coupled to the coupling protrusion wheel 12 of the outer container 10, and the inner lower extension protrusion wheel 57 is inserted into an inner upper portion of the first coupling body 40.

A pair of fastening grooves 58 coupled to a fastening protrusion 42 of the first coupling body 40 are formed on an outer side of the second coupling body 50.

In addition, the second coupling body 50 is formed on the outer side thereof with a rotation annular groove 59 to which the cap 80 and the opening/closing member 90 are rotatably coupled, and a rotation protrusion inserting groove 591 is formed at one side of the upper portion of the rotation annular groove 59.

The rotation annular groove 59 includes a rotation protrusion, rotating part 592 and a rotation protrusion restricting part 593, in which the rotation protrusion rotating part 592 is formed up to 180 degrees in the counterclockwise direction from the rotation protrusion inserting groove 591, and a depth of a groove of the rotation protrusion rotating part 592 is formed deeper than a depth of a groove of the rotation protrusion restricting part 593. Accordingly, rotation restricting sills 594 are formed at both ends of the rotation protrusion rotating part 592.

A latching groove 52 is formed on an outer periphery of the second coupling body 50, and the latching sill 53 is formed adjacent to the latching groove 52.

The second coupling body 50 is formed at the upper portion thereof with a first press prevention part 54 for preventing the pressing member 70 from being pressed due to a malfunction, and a first cap press prevention part 55 for preventing the cap cover 100 from being pressed due to a malfunction.

The pump 60 is installed while passing through the pump installation hole 41 of the first coupling body 40 and the pump penetration hole 51 of the second coupling body 50, thereby serving to pump the cosmetic material accommodated in the inner container 20 so as to discharge the cosmetic material to the outside.

The pump 60 is seated inside the pump installation hole 41 of the first, coupling body 40, and includes a cylinder 61 formed therein with a content suction hole 68, a check valve 62 for selectively opening/closing the content suction hole 68, a sealing member 63 coupled to an upper portion of the cylinder 61 to seal the inside of the cylinder 61, a piston 64 formed inside the cylinder 61, a piston ring 65 fitted to an outside of the piston 64 to make close contact with an inner side surface of the cylinder 61, a vertical moving member 66 coupled to an upper portion of the piston 64, and an elastic member 67 for elastically supporting the vertical moving members 66.

In addition, a sealing ring 69 may be further provided between the cylinder 61 of the pump 60 and the pump installation hole 41 of the first coupling body 40 to improve the sealing force inside the inner container 20.

The pressing member 70 is rotatably coupled to an upper portion of the vertical moving member 66 of the pump 60 so as to be exposed on the upper portion of the second coupling body 50, and the pressing member 70 is formed at one side thereof with the outlet 71 through which the pumped cosmetic material is discharged.

A second press prevention part 74 is formed below the outlet 71 of the pressing member 70 to prevent the pressing member 70 from being pressed due to a malfunction.

In other words, when the outlet 71 of the pressing member 70 is inserted inside the cap 80, a lower end of the second press prevention part 74 of the pressing member 70 abuts against an upper end of the first press prevention part 54 of the second coupling body 50, thereby preventing the pressing member 70 from being pressed downward, and when a user rotates the outer container 10 in the clockwise direction to enable the outlet 71 of the pressing member 70 to protrude to the outside, the second press prevention part 74 of the pressing member 70 is rotated together with the outer container 10, thereby preventing the second press prevention part 74 from abutting against the upper end of the first press prevention part 54 of the second coupling body 50, thus the pressing member 70 is pressed.

The cap 80 is rotatably coupled to the upper portion of the second coupling body 50, and formed at one side thereof with the outlet hiding/revealing hole 81 which the outlet 71 of the pressing member 70 is inserted into or protrudes from.

The cap 80 includes an outer wall 82 formed at one side thereof with the outlet hiding/revealing hole 81 and an inner wall 83 spaced apart from the outer wall 82 inward at a predetermined interval, and the cap guide groove 831 and the outlet penetration groove 832 are formed on the inner wall 83.

The outlet penetration groove 832 of the inner wall 83 is formed at a position corresponding to the outlet hiding/revealing hole 81 formed in the outer wall 82.

The rotation protrusion wheel 833 extends inward on the lower end of the inner wall 83 of the cap 80, and a rotation protrusion 834 further protrudes inward from one side of the rotation protrusion wheel 833, in which the rotation projection 834 is inserted into the rotation protrusion rotating part 592 of the rotation annular groove 59 through the rotation protrusion inserting groove 591 of the second coupling body 50, thereby rotating at 180 degrees in the clockwise or counterclockwise direction.

In other words, when the rotation protrusion 834 rotates up to 180 degrees within the rotation protrusion rotating part 592 of the second coupling body 50, the rotation is restricted through being latched to the rotation restricting sills 594 formed at the both ends of the rotation protrusion rotating part 592.

The opening/closing member 90 rotatably coupled to the second coupling body 50 is further provided on the upper portion of the second coupling body 50.

An opening/closing member rotation protrusion wheel 94 protrudes inward on an inner periphery of the opening/closing member 90, in which the opening/closing member rotation protrusion wheel 94 is fitted in the rotation annular groove 59 of the second coupling body 50 together with the rotation protrusion wheel 833 of the cap 80.

The sliding door 91 extends from the upper side surface of the opening/closing member 90, in which the sliding door 91 of the opening/closing member 90 is rotated between the outer wall 82 and the inner wall 83 of the cap 80 to open or close the outlet hiding/revealing hole 81.

An opening/closing protrusion 95 is formed on a lower inner periphery of the sliding door 91, and positioned below the outlet penetration groove 832 formed in the inner wall 83 of the cap 80 when assembled to the second coupling body 50 together with the cap 80.

The latching protrusion 92 and the stopper 93 adjacent to the latching protrusion 92 are formed on the lower end of the side surface of the opening/closing member 90.

The elastic groove 96 is formed on an upper side of the latching protrusion 92 of the opening/closing member 90 to enable the latching protrusion 92 to elastically move up and down.

In other words, when the user holds the cap 80 and rotates the outer container 10 fixed to the second coupling body 50 in the clockwise direction, the opening/closing member 90 is also rotated simultaneously because the latching protrusion 92 of the opening/closing member 90 is inserted into the latching groove 52 of the second coupling body 50, so that the sliding door 91 of the opening/closing member 90 opens the outlet hiding/revealing hole 81 of the cap 80.

When the outer container 10 is further rotated, the opening/closing protrusion 95 of the opening/closing member 90 makes contact with the outer side surface of the outlet penetration groove 832 of the cap 80, thus the rotation stops and the latching protrusion 92 of the opening/closing member 90 extends over the latching sill 53 of the second coupling body 50.

Then, when the outer container 10 fixed to the second coupling body 50 is further rotated in the clockwise direction, as shown in FIG. 8, the pump 60 biasedly installed in the second coupling body 50 and the push button 70 rotatably coupled to the upper portion of the pump 60 are rotated at 180 degrees, thereby being biased to the opposite side, thus the outlet 71 of the push button 70 protrudes to the outside through the outlet hiding/revealing hole 81 of the cap 80.

In addition, when the user holds the cap 80 again and rotates the outer container 10 fixed to the second coupling body 50 in the counterclockwise direction, the latching protrusion 92 of the opening/closing member 90 is latched to the latching sill 53 of the second coupling body 50, thus the opening/closing member 90 is rotated together with the second coupling body 50, thereby rotating the sliding door 91 of the opening/closing member 90 to close the outlet hiding/revealing hole 81 of the cap 80.

When the outer container 10 is further rotated, the latching protrusion 92 of the opening/closing member 30 extends over the latching sill 53 of the second coupling body 50 and is fastened into the latching groove 52, so a blocked state of the outlet hiding/revealing hole 81 is confirmed by a sense of a hand together with a clicking sound.

The cap 80 is further provided at an upper inner side thereof with the cap cover 100 for pressing the pressing member 70 while moving up and down.

A vertical guide protrusion 101 coupled to the cap guide groove 831 of the cap 80 for guiding a vertical movement of the cap cover 100 is formed on an outer side of the cap cover 100, and a second cap press prevention part 102 extends downward to prevent the cap cover 100 from, being pressed due to a malfunction.

In other words, when the outlet 71 of the pressing member 70 is inserted inside the cap 80, the lower end of the second press prevention part 102 of the cap cover 100 abuts against the upper end of the first cap press prevention part 55 of the second coupling body 50, thereby preventing the cap cover 100 from being pressed downward, and when the user rotates the outer container 10 in the clockwise direction to enable the outlet 11 of the pressing member 70 to protrude to the outside, the first cap press prevention part 55 of the second coupling body 50 is rotated together with the outer container 10, thereby preventing the first cap press prevention part 55 from abutting against the lower end of the second cap press prevention part 102 of the cap cover 100, thus the cap cover 100 is pressed.

An assembling method and a state of using the cosmetic container having a hiding/revealing pump outlet according to the embodiment of the present invention will be described in detail as below.

In order to assemble the cosmetic container having the hiding/revealing pump outlet, as shown in FIGS. 5 and 6, first, the pushing plate 30 is inserted into the inner container 20, the cosmetic material is accommodated therein, and then the inner container 20 is inserted into the outer container 10.

Next, the first coupling body 40 is inserted into and fixed to the upper end of the inner container 20, the pump 60 is installed in the pump installation hole 41 of the first coupling body 40, and then the second coupling body 50 is coupled to the upper portion of the first coupling body 40, in which the fastening protrusion 42 of the first coupling body 40 is coupled to the fastening groove 58 of the second coupling body 50, the inner lower extension protrusion wheel 57 of the second coupling body 50 is inserted inside the upper portion of the first coupling body 40, and the outer lower extension protrusion wheel 56 of the second coupling body 50 is fixed to the entrance 11 of the outer container 10.

Then, the pressing member 70 is rotatably coupled to the upper portion of the vertical moving member 66 of the pump 60, such that the second press prevention part 74 of the pressing member 70 abuts against the upper end of the first press prevention part 54 of the second coupling body 50.

In addition, the sealing ring 69 may be coupled between the pump installation hole 41 of the first coupling body 40 and the cylinder 61 of the pump 60 to improve the sealing force of the inner container 20.

Next, the opening/closing member 90 and the cap 80 are rotatably coupled to the upper portion of the second coupling body 30 assembled in the above manner, such that the opening/closing member rotation protrusion wheel 94 of the opening/closing member 90 and the rotation protrusion wheel 833 of the cap 80 are sequentially fitted into the rotation annular groove 59 of the second coupling body 50.

At this time, the opening/closing member 90 is inserted between the outer wall 82 and the inner wall 83 of the cap 80, the sliding door 91 of the opening/closing member 90 is located between the outlet hiding/revealing hole 81 and the outlet penetration groove 832 of the cap 80, and the latching protrusion 92 of the opening/closing member 90 is inserted into the latching groove 52 of the second coupling body 50.

Finally, the cap cover 100 is coupled to the upper inner side of the cap 80, in which the vertical guide protrusion 101 of the cap cover 100 is coupled to the cap guide groove 831 of the cap 80, and the second cap press prevention part 102 of the cap cover 100 abuts against the upper end of the first cap press prevention part 55 of the second coupling body 50, thus the assembly of the cosmetic container having the hiding/revealing pump outlet according to the present invention is completed.

In order to use the cosmetic container having the hiding/revealing pump outlet assembled in the above manner, first, as shown in FIGS. 7 and 8, the cap 80 is held by one hand, and the outer container 10 is rotated at 180 degrees in the clockwise direction by the other hand.

Herein, when the outer container 10 is rotated in the clockwise direction, the inner container 10, the first coupling body 40 and the second coupling body 50 which are fixed to the outer container 10 are rotated together, and the pump 60 biasedly installed in the first and second coupling bodies 40 and 50 and the push button 70 coupled to the upper portion of the pump 60 are also rotated together.

Accordingly, the sliding door 91 of the opening/closing member 90 is rotated to open the outlet hiding/revealing hole 81 of the cap 80, the outlet 71 of the push button 70 starts to protrude to the outside through the outlet hiding/revealing hole 81 of the cap 80 as shown in the second drawing of FIG. 8, and the outlet 71 of the push button 70 completely protrudes from the outlet hiding/revealing hole 81 of the cap 80 as shown in the fourth drawing of FIG. 8. Herein, the push button 70 and the cap cover 100 are put in a state to be pressed.

Then, as shown in FIG. 10, the push button 70 making close contact, with the lower surface of the cap cover 100 moves downward to pump the pump 60 by pressing the cap cover 100, thus the contents are discharged to the outlet 71 for use.

The operating state in which the outlet 71 protrudes to the outside will be described in detail as below.

First, as shown in FIGS. 7 and 8, when the user holds the cap 80 and rotates the outer container 10 fixed to the second coupling body 50 in the clockwise direction, because the latching protrusion 92 of the opening/closing member 90 is inserted into the latching groove 52 of the second coupling body 50, the opening/closing member 90 is also rotated simultaneously, so that the sliding door 91 of the opening/closing member 90 opens the outlet hiding/revealing hole 81 of the cap 80. When the outer container 10 is further rotated, the opening/closing protrusion 95 of the opening/closing member 90 makes contact with the outer side surface of the outlet, penetration groove 832 of the cap 80, thus the rotation stops and the latching protrusion 92 of the opening/closing member 90 extends over the latching sill 53 of the second coupling body 50 as shown in FIG. 9.

Then, when the outer container 10 is further rotated, as shown in FIG. 8, the second coupling body 50 is rotated, and simultaneously, the pump 60 installed in the second assembly 50 and the push button 70 rotatably coupled to the upper portion of the pump 60 are rotated together, thus the outlet 71 formed at one side of the push button 70 gradually moves forward to protrude to the outside through the outlet hiding/revealing hole 81 of the cap 80.

Simultaneously, the first press prevention part 54 of the second coupling body 50 is rotated to be prevented from, abutting against the second press prevention part 74 of the pressing member 70, and the first cap press prevention part 55 of the second coupling body 50 is rotated to be prevented from abutting against the second cap press prevention part 102 of the cap cover 100, so that the push button 70 and the cap cover 100 are put in a state to be pressed.

Again, when the cap 80 is held by one hand, and the outer container 10 is rotated at 180 degrees in the counterclockwise direction by the other hand, the inner container 10, the first coupling body 40 and the second coupling body 50 which are fixed to the outer container 10 are rotated together, and the pump 60 biasedly installed in the first and second coupling bodies 40 and 50 and the push button 70 coupled to the upper portion of the pump 60 are also rotated together.

Accordingly, the outlet 71 of the push button 70 is inserted into the cap 80, the sliding door 91 of the opening/closing member 90 closes the outlet hiding/revealing hole 81 of the cap 80, and the push button 70 and the cap cover 100 are put in a state which is net pressed.

The operating state in which the outlet 71 is inserted into the cap in the above manner will be described in detail as below.

First, when the user holds the cap 80 and rotates the outer container 10 fixed to the second coupling body 50 is rotated in the counterclockwise direction, the second coupling body 50 is rotated, and simultaneously, the pump 60 installed in the second assembly 50 and the push button 70 rotatably coupled to the upper portion of the pump 60 are rotated together, thus the outlet 71 formed at one side of the push button 70 gradually moves backward to be inserted into the cap 80.

Then, when the outer container 10 is further rotated, the latching protrusion 92 of the opening/closing member 90 is latched to the latching sill 53 of the second coupling body 50, thus the opening/closing member 90 is rotated together with the second coupling body 50, thereby rotating the sliding door 91 of the opening/closing member 90 to close the outlet hiding/revealing hole 81 of the cap 80. When the outer container 10 is further rotated, the latching protrusion 92 of the opening/closing member 90 extends over the latching sill 53 of the second coupling body 50 and is fastened into the latching groove 52.

Simultaneously, the first press prevention part 54 of the second coupling body 50 is rotated to abut against the lower portion of the second press prevention part 74 the pressing member 70, and the first cap press prevention part 55 of the second coupling body 50 is rotated to abut against the lower portion of the second cap press prevention part 102 of the cap cover 100, thus the push button 70 and the cap cover 100 are put in a state which is not pressed.

The aforementioned description of the present invention is just one of embodiments for carrying out the cosmetic container having the hiding/revealing pump outlet, and the present invention is not limited to the embodiments. It will be apparent to those having ordinary skills in the art in that various substitutions, deformations and modifications are construed to be available within the scope without departing from the invention.

[Reference Numerals]

| | |
|---|---|
| 10: outer container | 20: inner container |
| 30: pushing plate | 40: first coupling body |
| 41: pump installation hole | 50: second coupling body |
| 51: pump penetration hole | 52: latching groove |
| 53: latching sill | 54: first press prevention part |
| 55: first cap press prevention part | |
| 59: rotation annular groove | 60: pump |
| 69: sealing ring | 70: pressing member |
| 71: outlet | 72: second press prevention part |
| 80: cap | 81: outlet hiding/revealing hole |
| 90: opening/closing member | 91: sliding door |
| 92: latching protrusion | 93: stopper |
| 96: elastic groove | 100: cap cover |
| 101: vertical guide protrusion | |
| 102: second cap press prevention part | |

The invention claimed is:

1. A cosmetic container having a pump outlet, the cosmetic container comprising:

an outer container (10) formed at an upper portion thereof with an entrance (11);

an inner container (20) inserted into the outer container (10) for accommodating a cosmetic material in the inner container (20);

a first coupling body (40) fixed to an upper portion of the inner container (20), and having a pump installation hole (41) eccentrically formed in the first coupling body (40);

a second coupling body (50) fixed to an upper portion of the first coupling body (40), and having a pump penetration hole (51) eccentrically formed in the second coupling body (50);

a pump (60) installed while passing through the pump installation hole (41) of the first coupling body (40) and the pump penetration hole (51) of the second coupling body (50) to pump the cosmetic material;

a pressing member (70) rotatably coupled to an upper portion of the pump (60) while being exposed on an upper portion of the second coupling body (50), and formed at one side thereof with an outlet (71);

a cap (80) rotatably coupled to the upper portion of the second coupling body (50), and formed at one side thereof with an outlet hole (81); and a member (90) rotatably coupled to the upper portion of the second coupling body (50), wherein a sliding door (91) for opening and closing the outlet hole (81) of the cap (80) extends from an upper side surface of the member (90).

2. The cosmetic container of claim 1, wherein the member (90) is formed on a lower end of the side surface thereof with a latching protrusion (92) and a stopper (93) adjacent to the latching protrusion (92).

3. The cosmetic container of claim 1, wherein the second coupling body (50) is formed on an outer periphery thereof with a latching groove (52) and a latching sill (53) adjacent to the latching groove (52).

4. The cosmetic container of claim 1, wherein a first press prevention part (54) is formed on the upper portion of the second coupling body (50), and a second press prevention part (74) is formed on a lower side of the outlet (71) of the pressing member (70).

* * * * *